US009592662B2

(12) United States Patent
Thiemann et al.

(10) Patent No.: US 9,592,662 B2
(45) Date of Patent: Mar. 14, 2017

(54) METHOD TO DAMP AN OSCILLATION OF A DRIVEN ROLLER IN A PRINTING SYSTEM

(71) Applicant: Oce Printing Systems GmbH & Co. KG, Poing (DE)

(72) Inventors: Peter Thiemann, Munich (DE); Stephan Pilsl, Roehrmoos (DE); Martin Pappenberger, Tuntenhausen (DE)

(73) Assignee: Océ Printing Systems GmbH & Co. KG, Poing (DE)

( * ) Notice: Subject to any disclaimer, the term of this patent is extended or adjusted under 35 U.S.C. 154(b) by 0 days.

(21) Appl. No.: 14/856,759

(22) Filed: Sep. 17, 2015

(65) Prior Publication Data

US 2016/0082717 A1 Mar. 24, 2016

(30) Foreign Application Priority Data

Sep. 24, 2014 (DE) ..... 10 2014 113 810

(51) Int. Cl.

| | |
|---|---|
| ***B41F 13/004*** | (2006.01) |
| ***B41F 33/00*** | (2006.01) |
| ***B41F 13/02*** | (2006.01) |
| ***B41F 13/08*** | (2006.01) |

(52) U.S. Cl.

CPC ..... *B41F 33/0054* (2013.01); *B41F 13/0045* (2013.01); *B41F 13/02* (2013.01); *B41F 13/085* (2013.01); *B41P 2213/42* (2013.01)

(58) Field of Classification Search

CPC ... B41J 29/00; B41J 29/10; B41J 29/08; B41J 23/02; B41J 29/38

See application file for complete search history.

(56) References Cited

U.S. PATENT DOCUMENTS

| | | | | |
|---|---|---|---|---|
| 8,448,572 | B2 | 5/2013 | Yang et al. | |
| 2002/0015163 | A1* | 2/2002 | Singer | B41J 19/202 358/1.5 |
| 2009/0324259 | A1* | 12/2009 | Ue | G03G 15/5079 399/9 |
| 2010/0054835 | A1* | 3/2010 | Hayashi | B41J 19/202 400/76 |
| 2011/0090269 | A1* | 4/2011 | Ogura | B41J 19/04 347/9 |

FOREIGN PATENT DOCUMENTS

| | | | |
|---|---|---|---|
| DE | 10107135 | A1 | 8/2002 |
| DE | 102007006683 | A1 | 8/2008 |

* cited by examiner

*Primary Examiner* — David Banh

(74) *Attorney, Agent, or Firm* — Schiff Hardin LLP

(57) ABSTRACT

In a method to damp an oscillation of a roller driven via a drive in a printing system, a printing substrate web is directed across the roller, the roller and the printing substrate web forming a system capable of vibrating. With the drive the roller is driven with a predetermined nominal moment. With a sensor, a real value is determined of a variable representative of a velocity with which the printing substrate web is transported by the roller. In aid of a predetermined calculation rule, a correction moment is calculated from the determined real value such that a damping of the vibration-capable system results like a mechanical viscous damper. The correction moment is added to the predetermined nominal moment upon activation of the drive.

11 Claims, 7 Drawing Sheets

FIG. 4

| Excitation due to: | Pole pairs | Deflection roller | Drive roller | Cooling roller |
|---|---|---|---|---|
| **D in mm:** | **19.6** | **68** | **98** | **250** |
| Circumference: | **61.6** | **213.6** | **307.9** | **785.4** |
| **v in m/s** | Excitation frequencies in Hz | | | |
| **0.10** | 1.62 | 0.47 | 0.32 | 0.13 |
| **0.15** | 2.44 | 0.70 | 0.49 | 0.19 |
| **0.20** | 3.25 | 0.94 | 0.65 | 0.25 |
| **0.30** | 4.87 | 1.40 | 0.97 | 0.38 |
| **0.40** | 6.50 | 1.87 | 1.30 | 0.51 |
| **0.50** | 8.12 * | 2.34 | 1.62 | 0.64 |
| **0.60** | 9.74 | 2.81 | 1.95 | 0.76 |
| **0.70** | 11.37 | 3.28 | 2.27 | 0.89 |
| **0.80** | 12.99 | 3.74 | 2.60 | 1.02 |
| **0.90** | 14.62 | 4.21 | 2.92 | 1.15 |
| **1.00** | 16.24 | 4.68 | 3.25 | 1.27 |
| **1.10** | 17.86 | 5.15 | 3.57 | 1.40 |
| **1.20** | 19.49 | 5.62 | 3.90 | 1.53 |
| **1.25** | 20.30 | 5.85 | 4.06 | 1.59 |
| **1.30** | 21.11 | 6.09 | 4.22 | 1.66 |
| **1.40** | 22.74 | 6.55 | 4.55 | 1.78 |
| **1.50** | 24.36 | 7.02 | 4.87 | 1.91 |
| **1.60** | 25.98 | 7.49 | 5.20 | 2.04 |
| **1.70** | 27.61 | 7.96 * | 5.52 | 2.16 |
| **1.75** | 28.42 | 8.19 | 5.68 | 2.23 |
| **1.80** | 29.23 | 8.43 | 5.85 | 2.29 |
| **1.90** | 30.86 | 8.89 | 6.17 | 2.42 |
| **2.00** | 32.48 | 9.36 | 6.50 | 2.55 |
| **2.10** | 34.10 | 9.83 | 6.82 | 2.67 |
| **2.20** | 35.73 | 10.30 | 7.15 | 2.80 |
| **2.30** | 37.35 | 10.77 | 7.47 | 2.93 |
| **2.40** | 38.98 | 11.23 | 7.80 * | 3.06 |
| **2.50** | 40.60 | 11.70 | 8.12 | 3.18 |
| approximate nominal print speeds | Eigenfrequencies, web-dependent, from 4 to 18 Hz | | | |

* Resonance ranges, for example at eigenfrequency: 7.68 Hz

METHOD TO DAMP AN OSCILLATION OF A DRIVEN ROLLER IN A PRINTING SYSTEM

BACKGROUND

The disclosure concerns a method for damping an oscillation of a roller in a printing system, the roller being driven via a drive, in which a printing substrate web is directed across the roller. The drive drives the roller with a predetermined (in particular constant) nominal moment of inertia. The roller and the printing substrate web form a system that is capable of vibrating.

In the printing system, the printing substrate web is directed across a plurality of rollers, wherein the printing substrate web and the rollers together may form a system capable of vibrating in which a mass of the vibrating system is formed in particular by rollers with a high moment of inertia, and an elasticity is formed due to the printing substrate web.

In particular given what are known as cross-turners that are used in order to turn the printing substrate web between two printers such that the printing substrate web may be printed on both sides, problems often occur due to oscillations since—given such oscillations—the natural frequency of the vibration-capable system may coincide with an excitation frequency, such that it leads to a resonance and the oscillation correspondingly reinforces itself. This leads to high oscillations in a tension within the printing substrate web which may propagate into the image-generating transfer-printing regions of the printing units, and thus may lead to color registration errors. Moreover, due to too high a tension a tear of the printing substrate web may arise, in particular upon printing of perforated webs. Such printing systems also often have monitors for the tension of the printing substrate web that may be triggered by such resource oscillations, which may lead to the shutdown of the printing system. Moreover, slackening may occur which in turn may lead to a synchronization loss upon printing to the front side and the back side.

Cross-turners are particularly susceptible to such resonance oscillations since a cooling roller that has a very large moment of inertia may be built into them. Depending on the velocity with which the printing substrate web is transported through the printing system, an excitation with the different frequencies occurs due to eccentricities of rollers across which the printing substrate web is directed. If this excitation frequency coincides with the natural frequency of the vibration-capable system that is formed by cooling rollers and the printing substrate web, a corresponding resonance occurs.

The natural frequency lies in the range between 4 and 18 Hz, depending on the cross section and material of the printing substrate web. Depending on the velocity, the excitation frequency may be between 0 and 40 Hz, wherein different excitation frequencies occur due to the different diameters of the different installed rollers and the respective eccentricity of these rollers at the same velocity, such that the occurrence of a resonance case is very probable.

A first known possibility to avoid errors due to oscillations is to avoid the printing system being operated in the dangerous resonance ranges. For this, upon varying the velocity with which the printing substrate web is transported these variations are implemented as quickly as possible in order to pass through the resonance range quickly.

However, in this method it is disadvantageous that it is nearly impossible to reliably circumvent the resonance ranges, due to the many different rollers and the different excitation frequencies that they generate and the different natural frequencies depending on the printing substrate web that is used.

An additional known method to avoid problems with oscillations is to move the resonance ranges so that they lie outside of the typical operating states of the printing system. For example, from the document US 2011/0315031 A1 corresponding to U.S. Pat. No. 8,448,572 it is known that, for this purpose, deflection rollers are displaced in order to thus alter the spring constant of the elastic printing substrate web, and thus to change the natural frequency of the vibrating system. However, in this method it is disadvantageous that a complicated adaptation is necessary for every printing substrate web that is used.

An additional known method to reduce resonance problems is that the excitation amplitudes are minimized. One possibility for this is to attempt to minimize the eccentricities of the rollers across which the printing substrate web is directed, such that only a minimum excitation takes place. However, this is linked with very high costs.

An additional possibility to avoid resonance problems is to damp the occurring oscillations. Such a damping may take place mechanically and/or electrically via a controller.

Given a mechanical damping, in particular mechanical viscous dampers are used in which a closed housing is borne on the shaft to be damped so as to form a seal, wherein this sealed housing is filled with silicone oil. A disc is also arranged on the shaft, which disc rotates with the shaft and is arranged within the housing chamber filled with silicone oil. If an oscillation occurs, a moment proportional to the change of velocity results due to the viscous friction, which moment is directed counter to the oscillation and thus effects a damping at every point in time.

The disadvantage of such a mechanical viscous damper is that these are expensive, have a high weight, and take up a great deal of scarce structural space. Moreover, such mechanical viscous dampers lead to problems upon acceleration and braking of the driven roller since the viscous dampers must be accelerated or braked as well, such that an unnecessary expenditure of force and energy arises and the acceleration process or braking process is delayed. Moreover, heat is created due to the friction between the disc and the silicone oil, which heat may lead to a significant heating of the viscomechanical damper. Such viscomechanical dampers may also be modified to different application cases only at great expense.

Given electrical damping, the oscillation is determined and the control of the drive unit of the roller is adapted accordingly such that the oscillation is damped.

For this, from the document EP 1 837 178 A2 a method is known for compensation of a vibration in which a frequency spectrum of the vibration is determined and is divided up into frequency portions, wherein multiple counter-moments are determined via the division into the frequency portions, via which counter-moments the vibrations are compensated. In this method it is disadvantageous that the recording of system parameters is necessary for this, and in particular all excitation frequencies and amplitudes of the printing system must be determined in a complicated manner for this. In particular, expensive sensors are necessary for this.

From the document DE 101 07 135 A1, a method for vibration damping in a printing machine is known in which multiple rollers roll on one another. An active damping is hereby provided in which occurring position deviations of at least one roller are detected and respective countering damping forces are provided at at least one roller.

The document DE 10 2007 006 683 A1 describes a method for active vibration damping given counter-rotating rollers. Used for this are: at least one sensor for detection of the vibration at at least one roller; a regulator to process the vibration data detected by the at least one sensor and to emit at least one control signal based on these vibration data; as well as at least one actuator that charges at least one of the rollers with one of the forces counteracting the vibration on the basis of the at least one control signal.

SUMMARY

It is an object to specify a method to damp an oscillation of a roller driven via a drive in a printing system, with the aid of which method oscillations may be simply and reliably damped or even avoided.

In a method to damp an oscillation of a roller driven via a drive in a printing system, a printing substrate web is directed across the roller, the roller and the printing substrate web forming a system capable of vibrating. With the drive the roller is driven with a predetermined nominal moment. With a sensor, a real value is determined of a variable representative of a velocity with which the printing substrate web is transported by the roller. In aid of a predetermined calculation rule, a correction moment is calculated from the determined real value such that a damping of the vibration-capable system results like a mechanical viscous damper. The correction moment is added to the predetermined nominal moment upon activation of the drive.

BRIEF DESCRIPTION OF THE DRAWINGS

FIG. 4 is a table of resulting excitation frequencies and resonance ranges given an example natural frequency of approximately 8 Hz;

DESCRIPTION OF EXEMPLARY EMBODIMENTS

Figure 1:
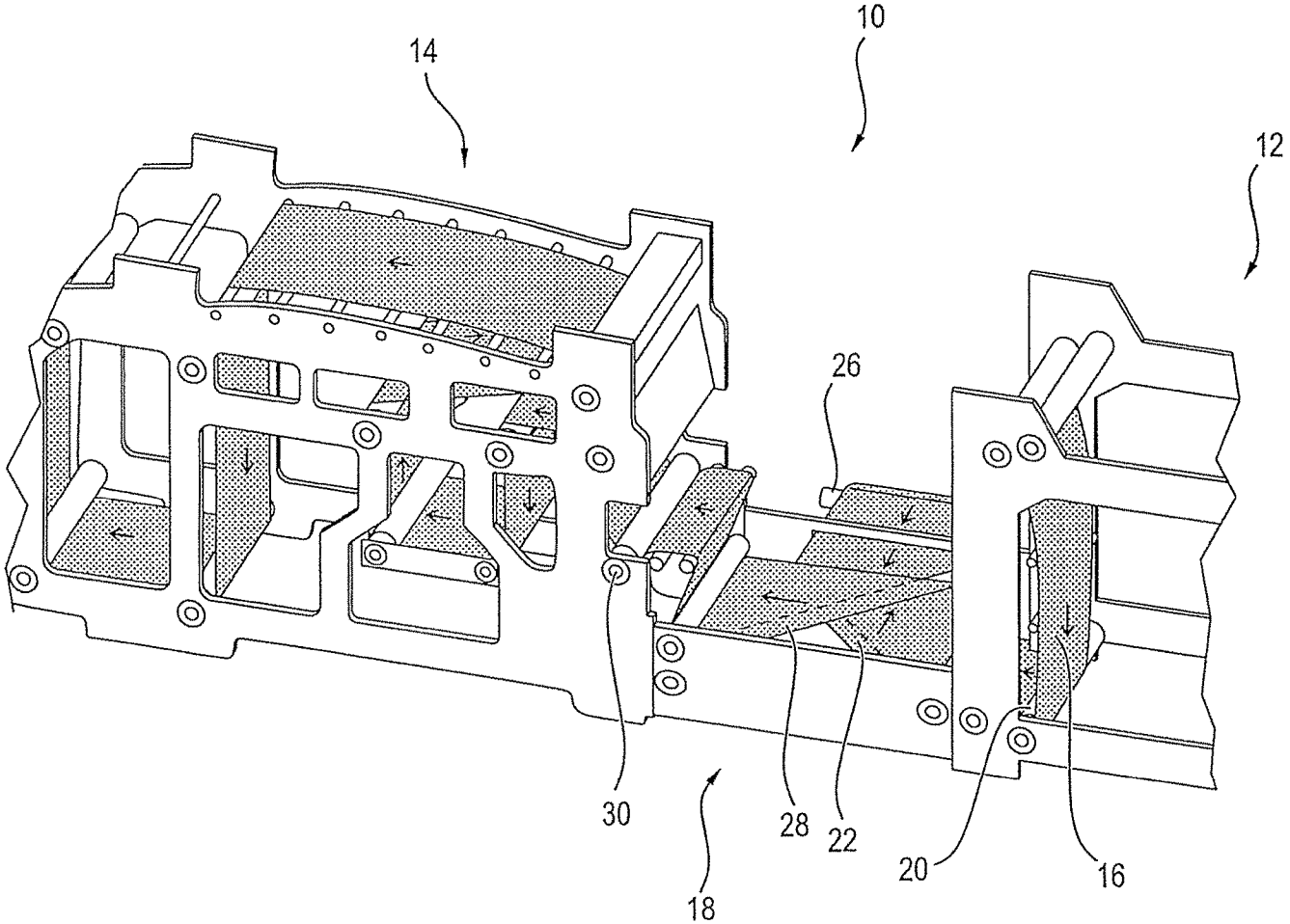
FIG. 1 is a schematic depiction of a section of a printing system.

For the purposes of promoting an understanding of the principles of the invention, reference will now be made to the preferred exemplary embodiments/best mode illustrated in the drawings and specific language will be used to describe the same. It will nevertheless be understood that no limitation of the scope of the of the invention is thereby intended, and such alterations and further modifications in the illustrated embodiments and such further applications of the principles of the invention as illustrated as would normally occur to one skilled in the art to which the invention relates are included herein.

According to an exemplary embodiment with a sensor a real value is determined of a variable that is representative of the velocity with which the printing substrate web is transported via the roller. With the aid of a predetermined calculation rule, from the determined real value a correction moment is calculated such that a damping of the vibration-capable system results given a mechanical viscous damper. This correction moment is subsequently added to the preset nominal moment in the controller of the drive such that the oscillation is compensated.

The property of a mechanical viscous damper is thus very simply reproduced electronically in the activation of the drive of the roller. This has the advantage that—on the one hand—the positive properties of a mechanical viscoelastic damper (namely that this damps oscillation reliably, without significant expenditure and depending on the occurring velocity change) are realized in a very simple manner, but—on the other hand—the disadvantages of a mechanical viscous damper are avoided. In particular, no additional components are necessary, such that costs, structural space and weight are saved. Moreover, the "electronic damper" does not need to be accelerated given the change of the velocity of the printing substrate web, such that no delays occur and the power consumption is minimized.

Such an electrical viscous damper also has the advantage that portions of the damping energy are dissipated automatically into the drives of the printing system and—in contrast to mechanical viscous dampers—only a very slight heating occurs.

Moreover, such electrical dampers may be adapted very simply to parameter changes of the printing system, such that different use cases may be damped with certainty without mechanical conversion.

Compared with known electrical dampers that also involve the control of the drive via correction moments, the method of the exemplary embodiment has the advantage that only the real value of the variable that is representative of the velocity must be determined, and then the damping of the oscillation may be controlled with a simple calculation rule without access to additional system parameters outside of the nominal velocity and without complicated analysis and determination of the oscillations and their frequencies. Only a minimal expense is thus necessary, and in particular no additional sensors need to be used since drive units that are used by default already have rotational speed sensors that may be used for the determination of the real value.

It is particularly advantageous if the rotational speed of the drive—in particular the rotational speed of a drive shaft of the drive—or the angular velocity of the drive shaft of the drive is determined as a representative variable. This may simply take place via rotational speed sensors that are already integrated into motors that are used by default. Alternatively, the velocity may also be determined via the rotational speed of the roller, the angular velocity of the roller, or the surface velocity of the roller. It is also alternatively possible that the velocity of the printing substrate web is determined in the region of the roller and used as a representative variable. Ultimately, all aforementioned variables may be converted to one another and represent a measure of the velocity with which the roller rotates at the moment. Since the drive is operated in a moment mode, the velocity with which the roller rotates and the velocity of the printing substrate web are always identical, such that the velocity of the roller (and thus of the drive shaft) always together represent the oscillations of the vibration-capable system.

The vibration-capable system is in particular made up of the roller and the printing substrate web. The roller is in particular a cooling roller of a cross-turner with which the printing substrate web is turned between printers, such that a two-sided printing is possible.

The real value is in particular determined with the aid of a rotational speed sensor of the drive of the roller, such that no separate sensor is required for this; rather, the entire method for damping the oscillation may be accomplished with components already present in the printing system, such that no additional costs arise.

Given a particularly preferred embodiment, not only a single real value but rather a real signal curve of the representative variable is determined. This in particular occurs in real time, in parallel with the operation.

Given a particularly preferred embodiment, a nominal signal curve of the representative variable is subtracted from this determined real signal curve of the representative variable. A difference curve hereby results which is subsequently differentiated. The curve that is obtained in such a manner is multiplied with a predetermined factor, whereby a correction moment curve results that is then added to the predetermined (in particular constant) nominal moment given the activation of the drive.

Via the subtraction of the real signal curve from the nominal signal curve it is achieved that the difference curve respectively indicates the unwanted oscillation without the actual nominal moment. Via the differentiation of this difference curve it is achieved that the change of the velocity is determined, and thus a signal proportional to the resulting unwanted oscillation results as given a viscomechanical damper. This signal corresponds to the results of all interfering moments exciting the oscillation. Via the multiplication with the predetermined factor, the necessary correction moment is subsequently determined from this. A viscoelastic mechanical damper is thus particularly simply simulated in the activation, and a reliable velocity-dependent damping of the system is achieved without great computational cost. The predetermined factor in particular has a constant value, wherein the predetermined factor in particular corresponds in terms of magnitude to the value of the moment of inertia of the vibrating mass, thus in particular to the value of the moment of inertia of the roller. Alternatively, the factor may also have a value less than the moment of inertia of the roller.

It is also advantageous if the nominal signal curve is differentiated directly—thus without subtraction of the real signal curve—in an additional calculation so that a signal curve results that reflects the change of the velocity. This obtained curve is in turn subsequently multiplied with a predetermined factor, wherein the predetermined factor hereby preferably in turn corresponds to the moment of inertia of the vibrating system (preferably the roller). The correction moment curve that is included in such a manner is likewise added to the desired moment and is accordingly taken into account in the activation of the drive unit of the roller.

Via this additional calculation rule, a pre-control is realized via which an additional moment is added to the nominal moment given an acceleration or braking of the roller in order to prevent delays in the acceleration or braking that are caused by the inertia of the roller. It is thereby achieved that a consistent resulting moment is exerted on the paper web, and thus no displacements in the color register or increases of the tensile stress of the web occur.

Without such a pre-control, the problem exists that the moment control of the drive unit delivers a constant moment but this applies directly only to the drive shaft of the drive unit. The moment acting on the printing substrate web is significantly altered by the forces arising due to the mass of the roller upon acceleration or braking, which upon braking results in the tensile stress of the web being increased. Conversely, upon acceleration it may lead to a drop of the web tension, which may lead to a slipping of the web guide.

In a particularly preferred embodiment of the invention, the two methods that are described in the preceding are implemented in parallel, and the correction moment curves that result from these are added to a resulting correction moment curve which is then added in turn to the nominal moment and is accordingly taken into account in the activation of the drive. It is hereby achieved that arising oscillations are damped via the first cited calculation, and the occurrence of oscillations upon changing the velocities is avoided or at least reduced via the pre-control that took place via the second cited calculation.

It is also advantageous if the mean transport velocity of the printing substrate web is used as a nominal signal curve, which median transport velocity may in particular be learned from the printing system in real time as a time-dependent nominal machine value. In particular, data that are already known many hereby be accessed.

The aforementioned method steps are in particular implemented automatically by a controller of the printing system. In particular, corresponding program data for this are stored in the controller, which program data are executed accordingly.

Additional features and advantages of the invention result from the following description, which explains the exemplary embodiments in connection with the accompanying drawing Figures.

A schematic, perspective depiction of a section of a printing system 10 is shown in FIG. 1. The printing system 10 comprises a first printer 12 to print to a first side of a printing substrate web 16 and a second printer 14 for printing to the second side of the printing substrate web 16 that is opposite the first side. The first and second printers 12, 14 are in particular of identical design.

Figure 2:
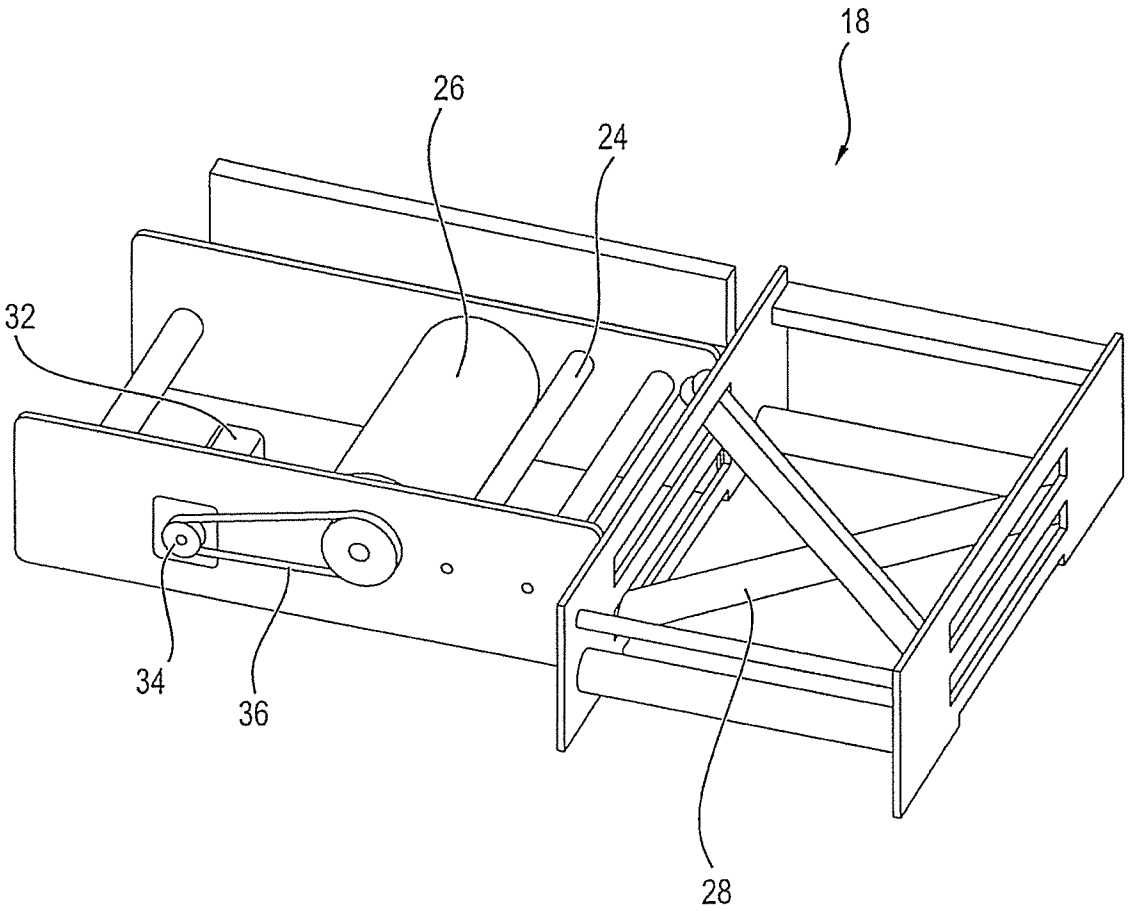
FIG. 2 is a schematic depiction of a cross-turner of the printing system according to FIG. 1.

A cross-turner 18—with the aid of which the printing substrate web 16 is turned so that both sides of said printing substrate web 16 may accordingly be printed to via the two printers 12, 14—shown in FIG. 2 is arranged between the first and second printers 12, 14.

The printing substrate web 16 is driven with a predetermined velocity via the first printer 12, wherein the first printer 12 forms the master drive. The printing substrate web 16 is subsequently directed first over a deflection roller 20 and then over a deflection rod 22 arranged at 45°. After the printing substrate web 16 has been directed over an additional deflection roller 24, it is directed around a cooling roller 26. Compared to the deflection rollers 20, 24 and the deflection rod 22, this cooling roller 26 has a significantly greater mass (in particular due to the cooling unit), and thus also a significantly greater moment of inertia.

After the printing substrate web 16 has been directed around the cooling roller 26, it is directed around an additional deflection rod 28 and an additional deflection roller 30 before it is then transported further in the second printer 14. In particular, a drive for the transport of the printing substrate web 16 with a predetermined velocity is likewise provided in turn in the second printer 14, wherein this drive is operated as a slave drive.

The cross-turner 18 comprises a drive 32 whose drive shaft 34 is coupled with the cooling roller 26 via a toothed belt 36. This drive 32 serves to drive the cooling roller 26, wherein the drive 32 is operated in a moment mode and drives the cooling roller 26 with a predetermined nominal moment.

Figure 3:
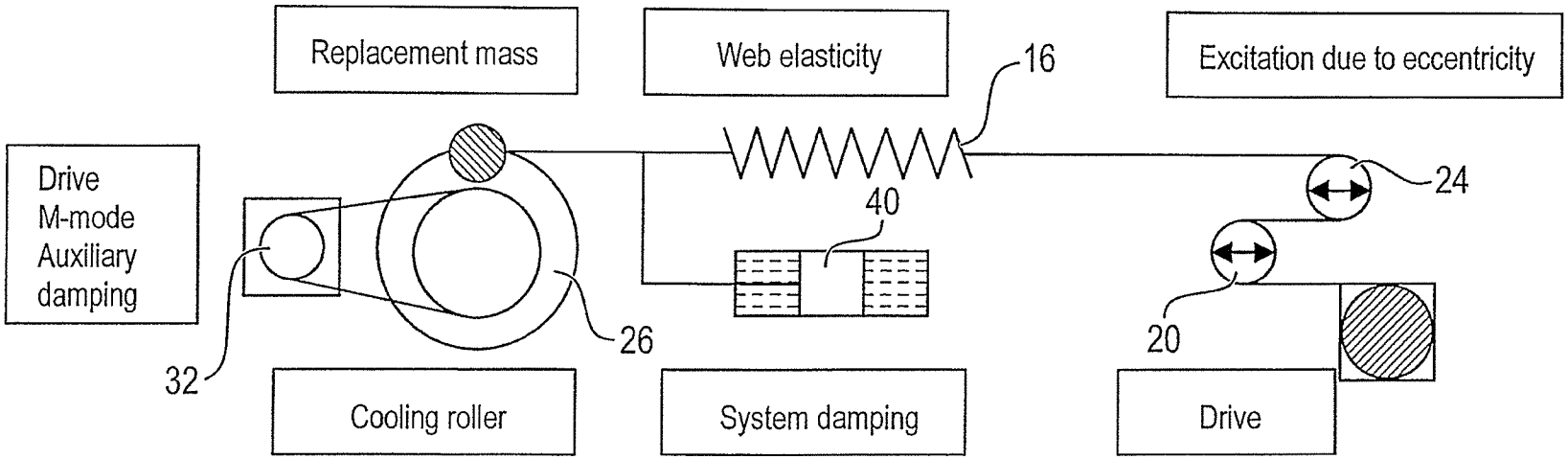
FIG. 3 is a schematic depiction of the vibration-capable system of the printing system according to FIGS. 1 and 2.

The cooling roller 26 and the printing substrate web 16 form a vibration-capable system, wherein a schematic analogous model of this vibration-capable system is depicted in FIG. 3. The mass of the vibration-capable system is formed by the cooling roller 26. Due to the elasticity of the printing substrate web, the corresponding restoring forces are exerted on this mass.

The natural frequency of the vibration-capable system is on the one hand dependent on the material of the printing substrate web 16, and on the other hand on the cross section of the printing substrate web 16. The natural frequency may be in a range between 4 and 18 Hz, wherein the natural frequency amounts to approximately 8 Hz given printing substrate webs that are used by default. Given particularly thin and/or narrow printing substrate webs 16, the natural frequency may even be only 4 Hz; given particularly wide printing substrate webs with higher grammage, the natural frequency may even be up to 18 Hz. The excitation of the vibration-capable system formed from the cooling roller 26 and the printing substrate web 16 in particular takes place due to eccentricities of the rollers over which the printing substrate web 16 is directed, wherein these eccentricities in particular result from production tolerances and inaccuracies. This is indicated as an example by the drawn rollers 20, 24 in FIG. 3. Moreover, the excitation also results due to non-uniformities of the moment formation with the frequency of the pole transition of the participating drives, thus in particular the drive 32 of the cooling roller 26 but also the other drives of the printers 12, 14.

In particular, problems then arise due to the occurring oscillations of the vibration-capable system if an excitation frequency with which the vibration-capable system is excited coincides with the natural frequency of the vibration-capable system, thus if resonance exists. In particular, this may lead to the situation that the printing substrate web 16 tears and/or deviations in the color register occur.

A table of the excitation frequencies resulting at different velocities of the printing substrate web 16 due to the irregularities of different modules is presented in FIG. 4. Hereby shown in the first column is velocity; in the second column, the respective excitation frequency resulting due to the pole pairs of the drive 32; in the third column, the excitation frequency resulting due to the eccentricity of the deflection roller 20; in the fourth column, the excitation frequencies resulting due to the eccentricity of the drive shaft; and in the last column, the excitation frequencies resulting due to the eccentricity of the cooling roller. Since the respective cooling rollers have a different diameter and a different circumference, given one and the same velocity the corresponding excitation frequency is markedly different, which—as may be learned from the table and is explained in further detail in the following—has the result that excitation frequencies in the range of the typical natural frequency of 8 Hz occur at all common operating velocities of the printing substrate web 16.

Given a velocity of 0.5 m/s, an excitation with a frequency of approximately 8 Hz (and thus resonance) arises due to the pole pairs. In contrast to this, at a velocity of 1.7 m/s an excitation with a frequency of 8 Hz—thus the natural frequency of the vibration-capable system—takes place due to the deflection roller 20. In contrast to these, given a velocity between 2.4 and 2.5 m/s an excitation with a frequency of 8 Hz takes place via the drive shaft. If it is considered that differing natural frequencies in the range of 4 and 18 Hz result given different printing substrate webs 16, the table shows that—depending on the modified printing substrate web 16—resonances and significant problems may occur due to the oscillations at any operating velocity of the printing system 10.

Thus, it is nearly impossible to avoid such resonance problems via the shifting of the resonance ranges or the avoidance of the resonance ranges.

According to the exemplary embodiment, a damper 40 (FIG. 3) is therefore provided in the vibration-capable system, wherein this damper 40 is designed as an electrical damper that engages with the cooling roller 26 upon activation of the drive 32 and always adapts the driving of the cooling roller such that occurring oscillations are avoided or damped.

This electrical damper 40 is hereby realized such that it simulates mechanical viscous dampers. It is hereby achieved that the properties of a mechanical viscous damper—thus the velocity-dependent damping of the oscillation—are realized but the disadvantages are avoided.

Figure 5:
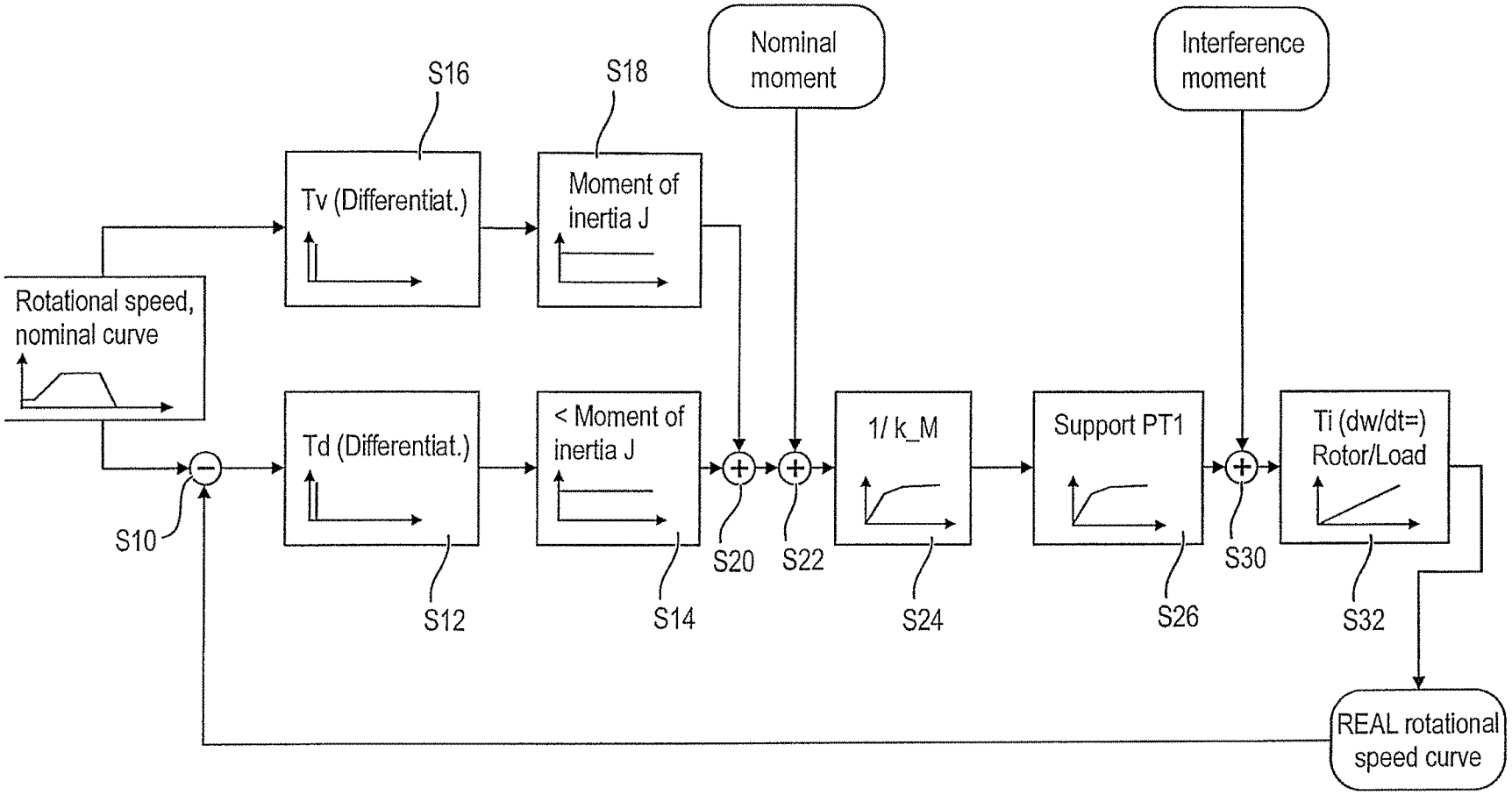
FIG. 5 is a signal flow diagram of a method for damping oscillations of the vibration-capable system according to FIG. 3.

FIG. 5 shows a signal flow diagram in which the calculation of the corresponding activation information for the drive 32 is presented. In FIG. 5, two damping methods are hereby presented in an integrated form; however, they may also be used individually.

For the damping of the oscillation, a real rotational speed curve is initially subtracted from a nominal rotational speed curve in step S10. The real rotational speed curve is in particular determined via a rotational speed sensor of the drive 32 that is already provided anyway in the drive 32, such that no additional modules are necessary and the method may be realized in a cost-neutral manner. In contrast to this, the nominal rotational speed curve is provided by the controller of the printing system.

The oscillation that is superimposed with the actual desired, nominal rotational speed curve is isolated via this subtraction of the real rotational speed curve from said nominal rotational speed curve.

In Step S12, the resulting difference curve is subsequently differentiated according to time, such that the change of the velocity results which is proportional to the unwanted resulting oscillation, and thus is proportional to the result of all interference moments generated by the exciting bodies.

In step S14, the resulting curve is subsequently multiplied with a predetermined factor which corresponds to the moment of inertia of the vibrating mass, thus in particular to the moment of inertia of the cooling roller. Alternatively, the factor may also have an absolute value smaller than the mass of the vibration-capable system. Via the multiplication with this predetermined factor, a correction moment results via which the oscillations of the vibration-capable system are damped in that the correction moment is added to the actual nominal moment with which the drive 32 drives the cooling roller 26.

In the case shown in FIG. 5, a second correction moment curve via which a pre-control is achieved is also determined in parallel with this first correction moment curve. For this, in step S16 the nominal rotational speed curve is differentiated directly (thus without the real rotational speed curve having previously been subtracted) and is in turn multiplied with the negative of the moment of inertia. This pre-control avoids changes in the tension of the printing substrate web 16 upon acceleration and/or braking of the printing substrate web 16 that result due to the inertia of the cooling roller 26. A second correction moment curve results from this.

In step S20, the first and second correction moment curves are added to form a resulting correction moment curve which then is in turn added with the nominal moment in step S22. The nominal moment that thus results is subsequently converted in steps S24 and S26 into the corresponding activation values for the drive 32. The actual velocity curve results in step S32 via the interaction of the activation and the interference moments due to the excitation frequencies that superimpose as indicated by step S30.

In an alternative method, only the damping expressed by steps S10 through S12 or the pre-control expressed by steps S16 and S18 may also be realized.

Figure 6:
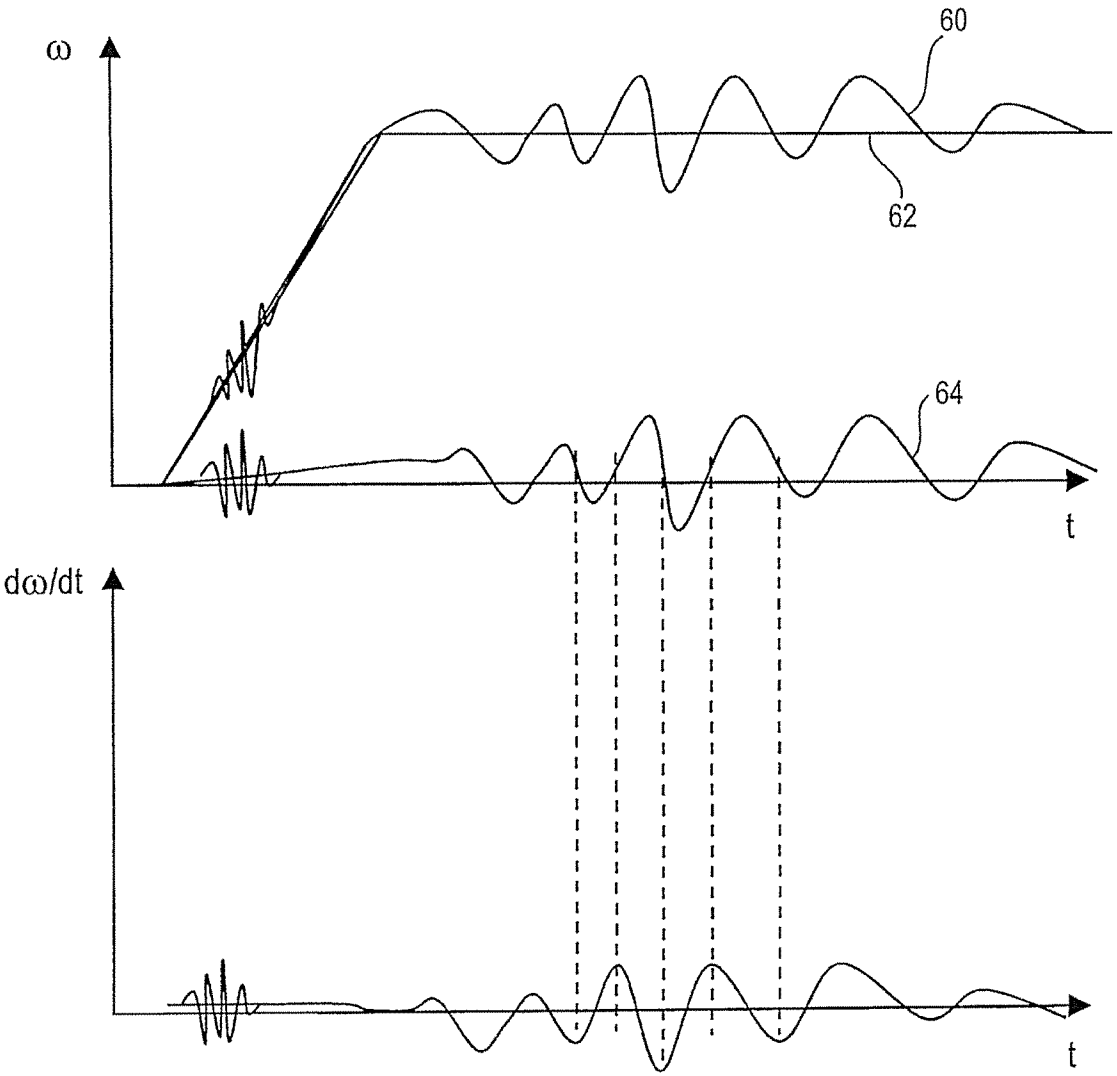
FIG. 6 is a diagram of the signal curves resulting during the calculation of the damping.

Two diagrams are presented in FIG. 6, wherein the rotational speed over time is plotted in the upper diagram. The line 60 hereby represents the determined real rotational speed; the line 62 represents the nominal rotational speed. The difference signal curve 64—in which only the unwanted oscillation is mapped—results via the subtraction in step S12.

Depicted in the lower diagram is the signal curve resulting via differentiation of the signal curve 64, which signal curve reflects the velocity change that is proportional to the interference moment and therefore, via multiplication with the corresponding predetermined factor, may simply be used for the effective damping.

Figure 8:
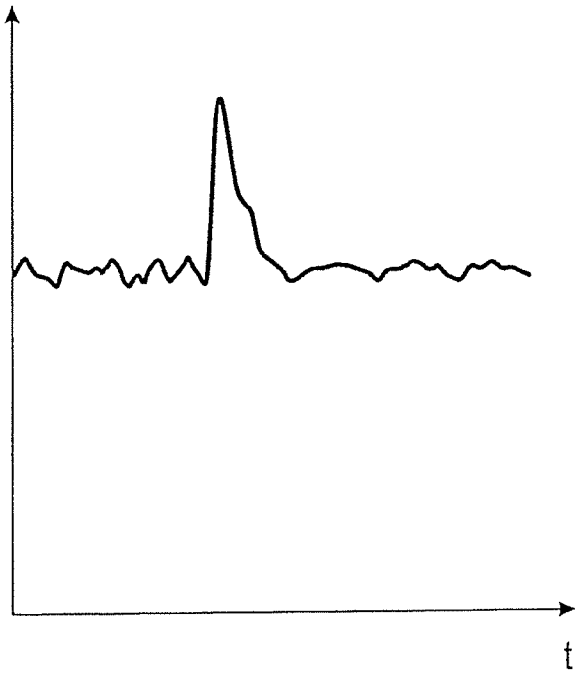
FIG. 8 is a signal curve of the same oscillation as in FIG. 7 given implementation of a damping according to the method according to FIG. 5.
Figure 7:
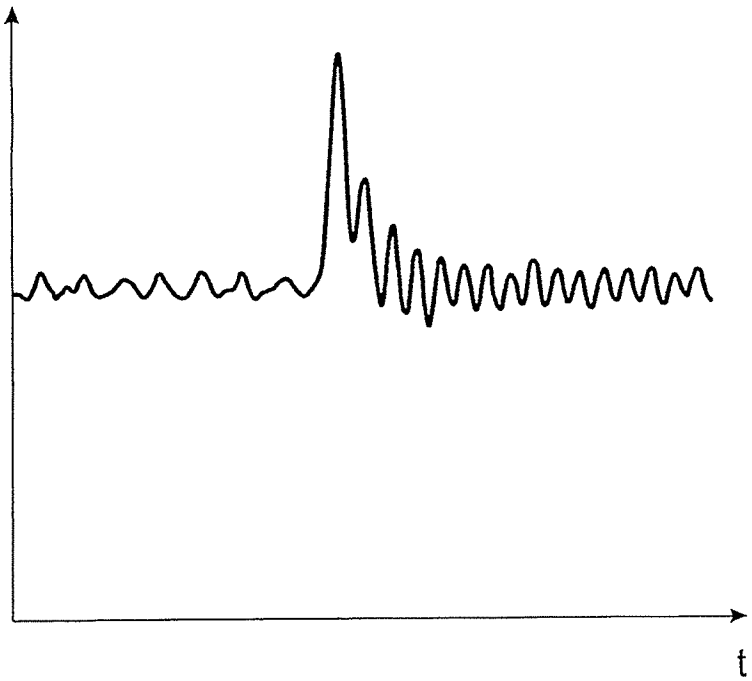
FIG. 7 is a signal curve of an oscillation without damping.

Experimentally determined curves of the oscillations of the vibration-capable system are presented in FIGS. 7 and 8, wherein the curve without the previously described damping is shown in FIG. 7 and the curve with the previously described damping is shown in FIG. 8. FIG. 8 clearly shows that the oscillation decays much more quickly, and thus far fewer problems occur.

Naturally, the method described in the preceding may also be applied in printing systems to all additional vibration-capable systems that result from a roller and the printing substrate web or multiple rollers and the printing substrate web, and is not limited to cooling rollers of cross-turners.

Overall, via the previously described damping method it is achieved that—solely via the change of the activation of the drives of the rollers—an effective damping is achieved without complicated sensors and computing processes being necessary for this.

In particular, a damping corresponding to a mechanical viscous damper is achieved without a mechanical viscous damper actually needing to be present, such that all of its disadvantages—in particular the resulting inertia, the high weight, the high costs and the additional modules—are avoided.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

We claim as our invention:

1. A method to damp an oscillation of a roller driven via a drive in a printing system, comprising the steps of:

directing a printing substrate web across the roller, the roller and the printing substrate web forming a system capable of vibrating;

with the drive, driving the roller with a predetermined nominal moment;

with aid of a sensor, determining a real value of a variable that is representative of a velocity with which the printing substrate web is transported by the roller;

with aid of a predetermined calculation rule, calculating a correction moment from the determined real value such that a damping of the vibration-capable system results like a mechanical viscous damper; and adding the correction moment to the predetermined nominal moment upon activation of the drive.

2. The method according to claim 1 in which at least one of a rotational speed of the drive, an angular velocity of a drive shaft of the drive, a rotational speed of the roller, an angular velocity of the roller, a surface velocity of the roller, and a velocity of the printing substrate web in a region of the roller is used as the representative variable.

3. The method according to claim 1 in which the real value is determined with aid of a moment sensor of the drive.

4. The method according to claim 1 in which a real signal curve of the representative variable is determined as the real value.

5. The method according to claim 4 in which a nominal signal curve is subtracted from the real signal curve, a difference curve that is thus obtained is differentiated, and the differentiated curve is multiplied with a predetermined factor to determine a first correction moment curve.

6. The method according to claim 5 in which the nominal signal curve is differentiated, and the differentiated nominal signal curve is multiplied with a predetermined factor to determine a second correction moment curve.

7. The method according to claim 4 in which a nominal signal curve is subtracted from the real signal curve, a difference curve thus obtained is differentiated, and the differentiated difference curve is multiplied with a predetermined factor to determine a first correction moment curve, the nominal signal curve is differentiated, and the differentiated nominal signal curve is multiplied with a predetermined factor to determine a second correction moment curve, the first and the second correction moment curves are added, and a resulting correction moment curve is then added to the predetermined nominal moment upon activation of the drive.

8. The method according to claim 4 in which the correction moment corresponds in terms of its magnitude to a moment of inertia of the roller.

9. The method according to claim 5 wherein the predetermined factor has a value less than a value of a moment of inertia of the roller.

10. The method according to claim 4 in which a mean transport velocity of the printing substrate web is used as a nominal signal curve.

11. A method to damp an oscillation of a roller driven via a drive in a printing system, comprising the steps of:

directing a printing substrate web across the roller, the roller and the printing substrate web forming a system capable of vibrating;

with the drive, driving the roller with a predetermined nominal moment;

with aid of a sensor, determining a real value of a variable that is representative of a velocity with which the printing substrate web is transported by the roller;

with aid of a predetermined calculation rule, calculating a correction moment from the determined real value such that a damping of the vibration-capable system results; and adding the correction moment to the predetermined nominal moment upon activation of the drive.

* * * * *